US009248946B2

(12) United States Patent
Glass

(10) Patent No.: US 9,248,946 B2
(45) Date of Patent: Feb. 2, 2016

(54) GIFT CARD HANGER SYSTEM

(75) Inventor: Brett R. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/114,893

(22) Filed: May 24, 2011

(65) Prior Publication Data

US 2012/0223144 A1 Sep. 6, 2012

Related U.S. Application Data

(60) Provisional application No. 61/347,493, filed on May 24, 2010, provisional application No. 61/441,835, filed on Feb. 11, 2011.

(51) Int. Cl.

| | |
|---|---|
| ***B65D 73/00*** | (2006.01) |
| ***B42D 15/04*** | (2006.01) |
| *B42D 25/20* | (2014.01) |

(52) U.S. Cl.

CPC ..... *B65D 73/0064* (2013.01); *B42D 15/045* (2013.01); *B65D 73/0028* (2013.01); *B42D 25/285* (2014.10)

(58) Field of Classification Search

CPC .. B42D 15/045; B42D 25/285; B42D 15/042; B42D 25/00; B65D 73/0064; B65D 73/0014; B65D 73/0078; B65D 73/0085

USPC ..... 235/380

See application file for complete search history.

(56) References Cited

U.S. PATENT DOCUMENTS

| | | | | |
|---|---|---|---|---|
| 5,740,915 | A | 4/1998 | Williams | |
| 5,791,474 | A | 8/1998 | Hansen | |
| 5,918,909 | A | 7/1999 | Fiala et al. | |
| 6,109,439 | A | 8/2000 | Goade, Sr. | |
| 6,224,108 | B1 | 5/2001 | Klure | |
| 6,315,206 | B1 | 11/2001 | Hansen et al. | |
| 6,418,648 | B1 | 7/2002 | Hollingsworth et al. | |
| 6,698,116 | B2 | 3/2004 | Waldron | |
| 6,957,737 | B1 | 10/2005 | Frederickson et al. | |
| 7,024,807 | B2 | 4/2006 | Street | |
| 7,374,095 | B2 * | 5/2008 | Blank | B65D 27/00 235/380 |
| 7,607,575 | B2 | 10/2009 | Kingsborough et al. | |
| 2002/0100797 | A1 | 8/2002 | Hollingsworth et al. | |
| 2004/0139318 | A1 | 7/2004 | Fiala et al. | |
| 2004/0217249 | A1 * | 11/2004 | Eisenbraun | 248/323 |
| 2006/0151348 | A1 | 7/2006 | Willard | |
| 2006/0157555 | A1 * | 7/2006 | Dean et al. | 235/380 |
| 2007/0277416 | A1 * | 12/2007 | Fedan | 40/642.02 |
| 2008/0048041 | A1 * | 2/2008 | Riley | 235/487 |
| 2008/0098628 | A1 * | 5/2008 | Geitner | 40/124.06 |
| 2008/0109350 | A1 * | 5/2008 | Lazarowicz et al. | 705/39 |
| 2008/0116089 | A1 | 5/2008 | Roberts | |
| 2009/0107862 | A1 * | 4/2009 | Pascua | B65D 75/14 206/232 |
| 2010/0133128 | A1 | 6/2010 | Preece | |

* cited by examiner

*Primary Examiner* — Christopher Stanford
(74) *Attorney, Agent, or Firm* — Polsinelli PC

(57) ABSTRACT

A system for hanging a gift card includes a gift card assembly suspended from a gift card holder assembly by a looped strip of flexible material. The gift card assembly includes a removeably attached gift card and the gift card holder assembly includes a gift card holder for receiving the gift card after detachment from the gift card assembly.

15 Claims, 6 Drawing Sheets

140
140a
140b
140c
125
150
A
140g
140d

~140a~
145
140
110
155
125
150
140g

~140b~
155
140g

~140a~
145
140
110
155
125
140d
127

~140b~
155
140d

~140b~
110
145
140
167
165
125

GIFT CARD HANGER SYSTEM

CROSS REFERENCE TO RELATED APPLICATION

This application claims the benefit of the prior filed, co-pending provisional applications Ser. No. 61/347,493, filed May 24, 2010 and Ser. No. 61/441,835, filed Feb. 11, 2011.

BACKGROUND OF THE INVENTION

This invention relates generally to gift cards and more particularly to a device for suspending or hanging a gift card from a gift card holder or greeting card.

Transaction cards, stored value cards, or gift cards as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or may be selected at the point of sale by the purchaser and loaded by the cashier using a magnetic card reader/writer. In some cases, the cash value is not stored upon the card itself but is associated with a card identification number and stored in a remote database. Alternatively, gift cards may be provided with a bar code or account number that links the card to a system account in which a record is stored associated with a monetary value. While popular, gift cards are typically provided with a generic and impersonal design, typically identifying only the associated merchant for which the card may be used to purchase merchandise, and therefore are not personalized in view of the intended recipient.

BRIEF DESCRIPTION OF THE INVENTION

The purpose of this invention is to provide a means for hanging or suspending a transaction card, such as a conventional gift card, mounted on a backer card or panel from a greeting card or gift card holder. The gift card holder typically includes indicia for indicating both the name of the sender and recipient of the gift card, decorations of various styles or themes, and one or more slots for inserting a gift card into the holder or other means such as adhesive for holding the gift card to or within the hold structure. The holder may be mounted on a first backer panel that includes a peg hole for hanging the first backer panel and attached holder upon a display rack peg. The holder may include electronics for recording and playing sound such as music and/or a message from the gift giver. The electronics may include a sound speaker, a power source such as one or more commonly available watch batteries, a control circuit, a memory chip for storing sound recordings, and record and playback buttons.

The gift card is typically mounted on a second backer panel that is also provided with a peg hole for either hanging the second backer panel upon a display rack peg or for use within the system disclosed herein. The gift card may be disposed upon the second backer panel so that the magnetic strip of the gift card projects below the lower margin of the second backer panel, or the second backer panel may be provided with a fold line, either structure thereby enabling the gift card magnetic strip to be scanned at the point of sale. Alternatively, in the case of a gift card provided with a bar code or other optically scannable indicia on the back of the gift card, the second backer panel may include a window in alignment with the scannable indicia so that the indicia may be scanned without removing the gift card from the second backer panel.

A strip or tab of acetate, plastic, paper or the like projecting from the lower margin of the first backer panel is looped through the peg hole of the second backer panel and then affixed via adhesive or equivalent means (e.g. hook and loop fasteners) to a surface of the first backer panel to form a loop by which the second backer panel and attached gift card may be hung or suspended from the first backer panel and/or gift card holder.

After purchase of the assembly comprising the gift card holder and gift card, the gift card may be removed from the second backer panel and installed within or upon the gift card holder. In certain embodiments, the gift card holder may then be detached from the first backer panel prior to giving the gift card holder bearing the gift card to a gift recipient.

An embodiment of a transaction card hanger system includes a transaction card assembly attached to a transaction card holder assembly by suspending the card assembly from the holder assembly via a looped tab secured at either end to the holder assembly. The transaction card assembly may include a panel bearing an attached transaction card. The transaction card holder assembly may include a panel bearing a transaction card holder.

Another embodiment of a transaction card hanger system includes a transaction card holder assembly. The transaction card holder assembly comprises a transaction card holder and a tab extending from the transaction card holder assembly. The tab has a free end for passing through an aperture in a transaction card assembly, which comprises a transaction card mounted upon a transaction card backer panel. The transaction card assembly is suspended from the transaction card holder assembly by passing the fee end of the tab through the aperture to attach to a surface of the transaction card holder assembly.

A gift card hanger system according to the present invention may include a gift card assembly attached to a gift card holder assembly by suspending the gift card assembly from the holder assembly by a looped tab secured at either end to the gift card holder assembly. The gift card assembly may include a panel bearing an attached gift card. The gift card holder assembly may include a panel bearing a gift card holder.

A gift card holder system according to the present invention may include a gift card holder assembly including a first backer panel, a detachable gift card holder attached to a face of the first backer panel, an elongated tab extending from a lower portion of the first backer panel, the tab including a free end, and a second backer panel including means for temporarily holding a gift card, the second backer panel including an aperture for accepting the free end therethrough, the first backer panel including means for attaching the free end to the first backer panel. The holder may include two hingedly connected panels and a means for holding a gift card. The holder may include three hingedly connected panels and a means for holding a gift card. The holder may include a container including a flap closure.

Other advantages of the invention will become apparent from the following description taken in connection with the accompanying drawings, wherein is set forth by way of illustration and example an embodiment of the present invention.

DETAILED DESCRIPTION

Figure 1:
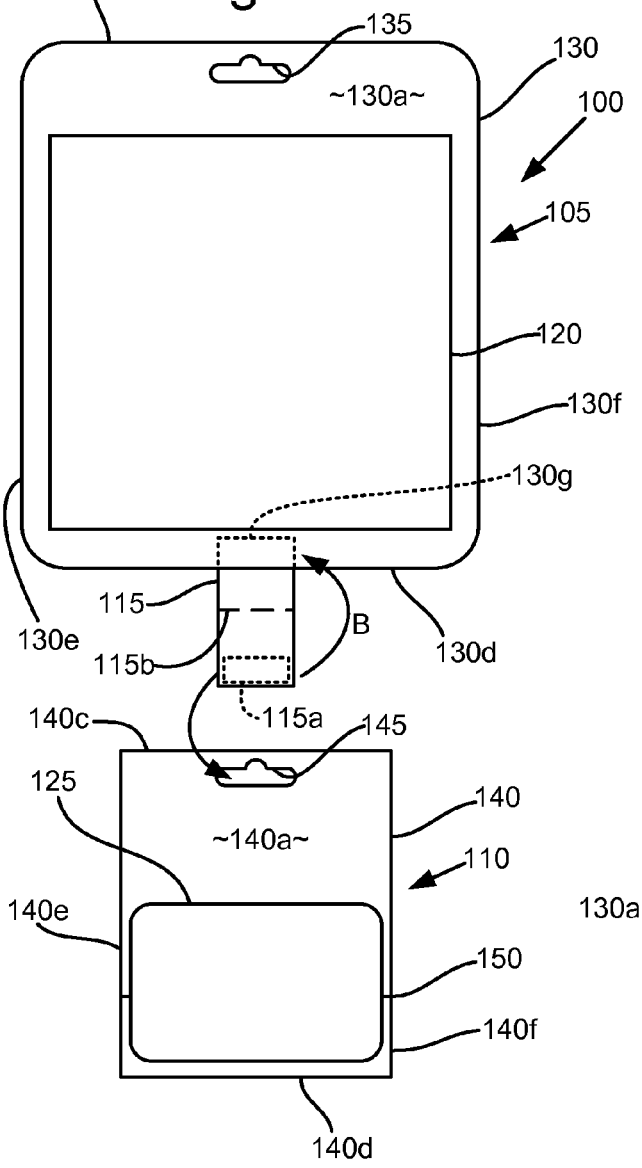
FIG. 1 is a front view of a gift card mounted upon a gift card backer panel prior to installation upon a gift card holder backer panel.

As required, one or more detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1 through 4, there is shown an embodiment of a system for hanging a transaction card, such as a gift card, as indicated generally by the reference numeral 100. The system 100 includes a gift card holder assembly 105 and a gift card assembly 110. The holder assembly 105 and gift card assembly 110 are attached to one another by suspending the gift card assembly 110 from the holder assembly 105 via a strip or tab 115.

The holder assembly 105 includes a gift card holder 120 for holding, retaining or storing a gift card 125 after removal of the gift card 125 from the gift card assembly 110. The holder 120 is typically formed of one or more relatively planar panels of cardstock or the like and typically includes indicia thereon for indicating both the names of the sender and recipient of a gift card 125, indicia for indicating a message thereon from the sender to the recipient, decorations of various styles or themes, and one or more slots for inserting a gift card 125 into the holder 120, or other means for holding the gift card 125 to, or within, the holder structure. When presented for sale, the holder 120 is typically mounted on a first backer panel 130 typically formed of card stock or the like. The first backer panel 130 includes a front surface 130a, rear surface 130*b*, top edge 130*c*, bottom edge 130*d*, left edge 130*e* and right edge 130*f*. A peg hole 135 is typically provided proximate the top edge 130*c* for hanging the first backer panel 130 and attached holder 120 upon a display rack peg (not shown). The holder 120 may include electronics for recording and playing sound such as music and/or a message from the gift giver. The electronics may include a sound speaker, a power source such as one or more commonly available watch batteries, a control circuit, a memory chip for storing sound recordings, and record and playback buttons.

Figures 5, 6, 7, 8, 9, 10:
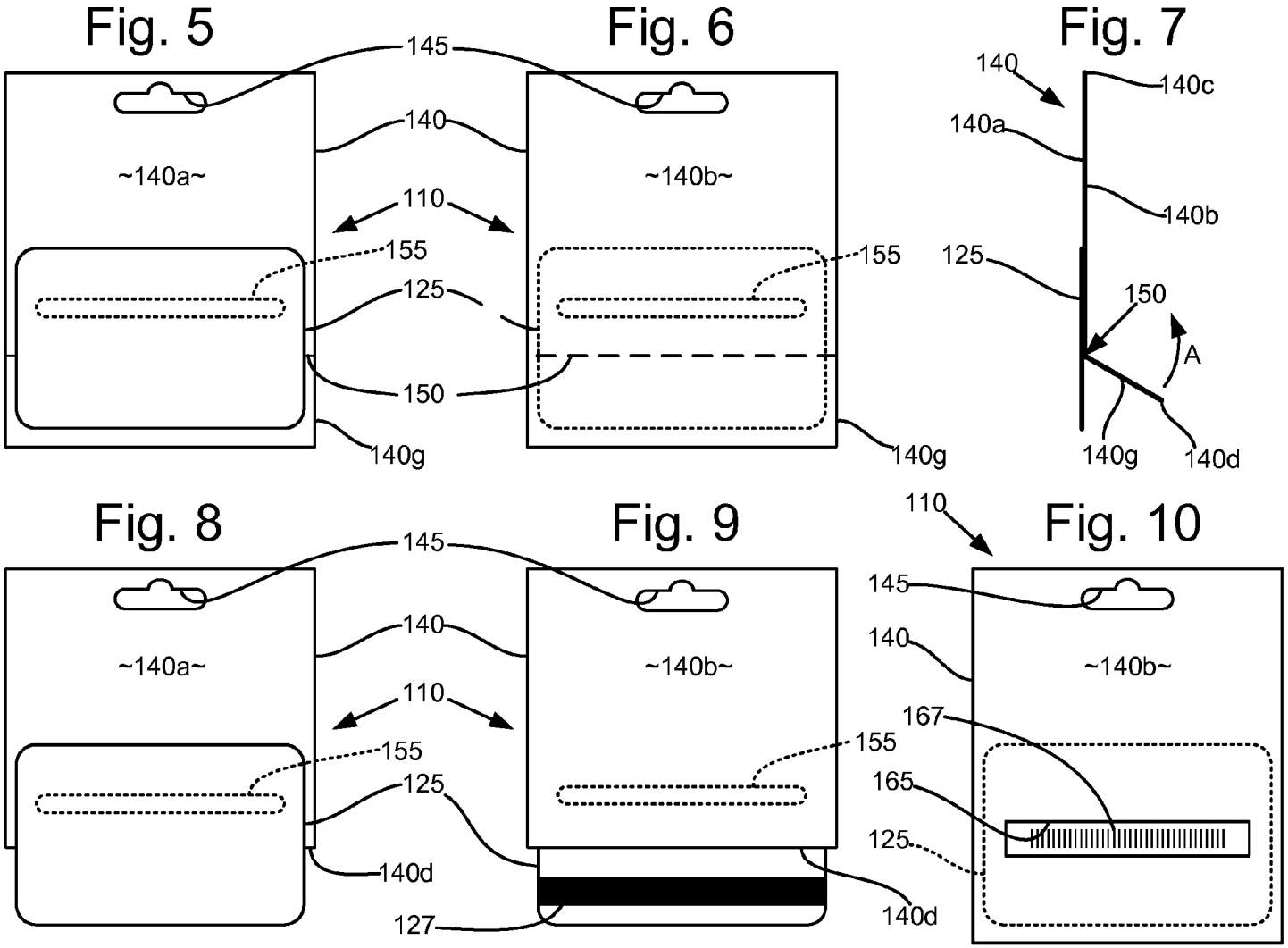
FIG. 5 is a front view of second backer panel.
FIG. 6 is a rear view of the second backer panel of FIG. 5 showing a fold line.
FIG. 7 is a side view of the second backer panel of FIG. 6 showing the lower portion of the second backer panel lifted upward and rearward and away from the lower portion of the gift card.
FIG. 8 is a front view of a second backer panel showing the gift card mounted to project below the bottom edge of the panel.
FIG. 9 is a rear view of the second backer panel of FIG. 8 showing the gift card magnetic strip.
FIG. 10 is a rear view of a second backer panel provided with a window for exposing a gift card bar code.

A gift card 125, typically provided with a magnetic strip, bar code and/or ID number associated with one or more monetary values or monetary accounts, is mounted on a second backer panel 140 using temporary or removable adhesive 155 or other operable means. In FIGS. 5 and 6, a strip of removable adhesive 155 (shown in phantom lines) is interposed between the gift card 125 and the front surface 140*a* of the second backer panel 140 to adhere the gift card 125 to the second backer panel 140.

The second backer panel 140 includes a front surface 140*a*, rear surface 140*b*, top edge 140*c*, bottom edge 140*d*, left edge 140*e* and right edge 140*f*. The second backer panel 140 is also typically provided with a peg hole 145 proximate the top edge 140*c* that may be used either for hanging the second backer panel 140 upon a display rack peg or for use within the system 100 disclosed herein.

As shown in FIGS. 5, 6 and 7, the second backer panel 140 may be provided with a fold line 150 that extends transversely across the second back panel 140 between the left edge 140*e* and right edge 140*f*. The fold line 150 and gift card 125 are positioned relative to each other so that the portion of the second backer panel 140 bearing the adhesive 155 (or other means of retaining or attaching the gift card 125 to the second backer panel 140) lies above the fold line 150. Typically, the fold line 150 will traverse the lower portion of the second backer panel 140. At the point of purchase of a device according to the system 100, the gift card 125 is typically scanned by the cashier to activate the gift card 125 or load it with a monetary or other value. To facilitate scanning, the bottom edge 140*d* of the second backer panel 140 is lifted upward, in the direction of arrow A, as shown in the side view of the second backer panel 140 in FIG. 7. The lower portion 140*g* of the second backer panel 140 that pivots about the fold line 150 may be referred to as a flap 140*g*. After the flap 140*g* is lifted, the magnetic strip 127 of the gift card 125 may be inserted into the slot of a magnetic card reader or scanner (not shown) without interference from or obstruction by the lower portion of the second backer panel 140.

Alternatively, as shown in FIGS. 8 and 9, the gift card 125 may be disposed upon the second backer panel 140 so that the magnetic strip 127 of the gift card 125 projects below the bottom edge 140*d* of the second backer panel 140. As shown in FIGS. 8 and 9, a shortened version of the second backer panel 140 may be used to expose the lower portion of the gift card 125 while retaining the same space above the gift card 125 on the front surface 140*a* of the second backer panel 140. Alternatively, the gift card 125 may simply be positioned further down upon the second backer panel 140. In such case, the fold line 150 may be omitted. Either structure enables the magnetic strip 127 to be readily scanned at the point of sale by passing exposed lower portion of the gift card 125, including the magnetic strip 127, through a card reader (not shown) without the need for removing the card 125 from the second backer panel 140.

Alternatively, in the case of a gift card 125 provided with a bar code or other optically scannable indicia on the back of the gift card 125, the second backer panel 140 may include an opening, aperture or window 165 in alignment with the bar code so that it may be scanned (typically at the point of sale) without removing the gift card 125 from the second backer panel 140. FIG. 10 provides a rear view of a second backer panel 140 showing the rear surface 140*b* and a window 165 in the lower portion of the second backer panel 140 disposed to align with a bar code 167 (visible through the window 165, see FIG. 10) on a rear surface of a gift card 125. The gift card 125, which is mounted on the front surface 140*a*, is indicated in phantom lines.

Figure 2:
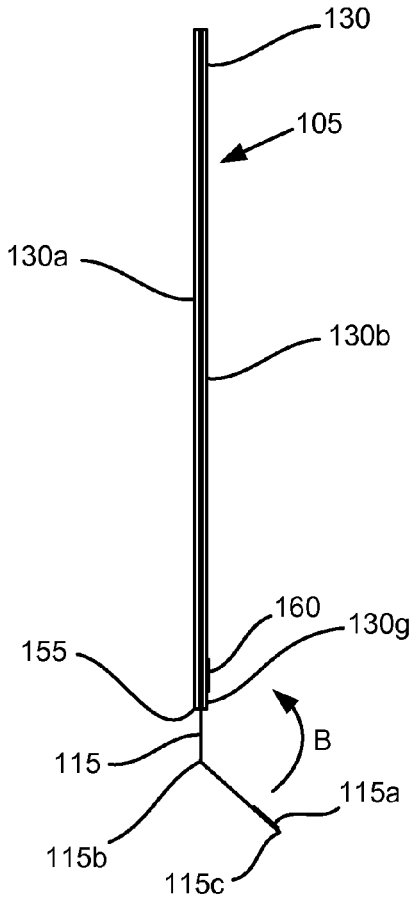
FIG. 2 is a side view of a gift card holder backer panel showing the tab projecting from the lower margin of the holder backer panel and partially bent upward and rearward.
Figure 3:
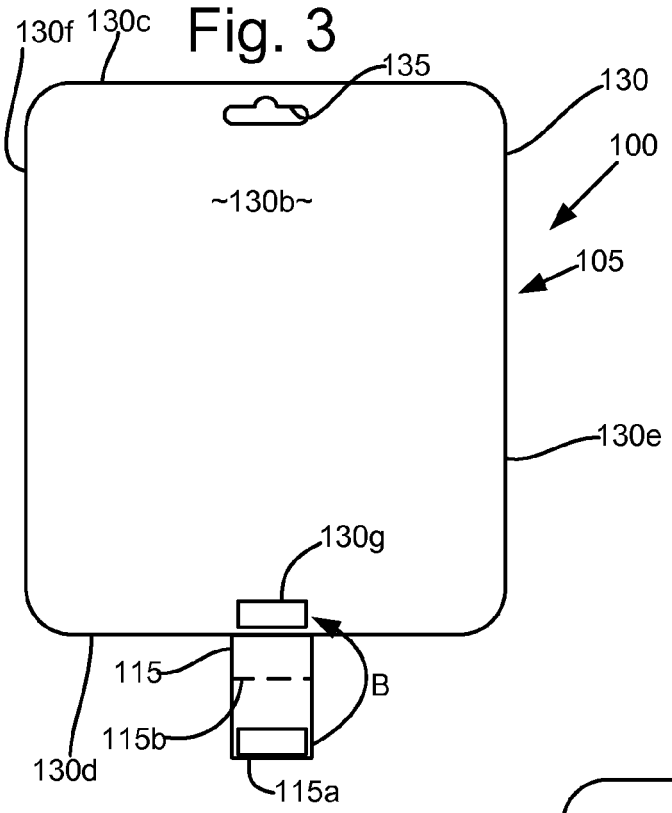
FIG. 3 is a rear view of a holder backer panel.

The gift card holder assembly 105 is provided with a strip or tab 115 projecting from the bottom edge 130*d* of the first backer panel 130. The tab 115 may be formed of acetate, plastic, paper or the like. Any operable material may be selected of appropriate flexibility and strength. As shown in FIG. 2, the upper portion of the tab 115 may be sandwiched and secured between front and back cooperating panels that form the first backer panel 130. Alternatively, and particularly when the first backer panel 130 is formed from a single sheet of material, the tab 115 may simply be attached to the front surface 130*a* or more preferably the rear surface 130*b* of the first backer panel 130.

Figure 4:
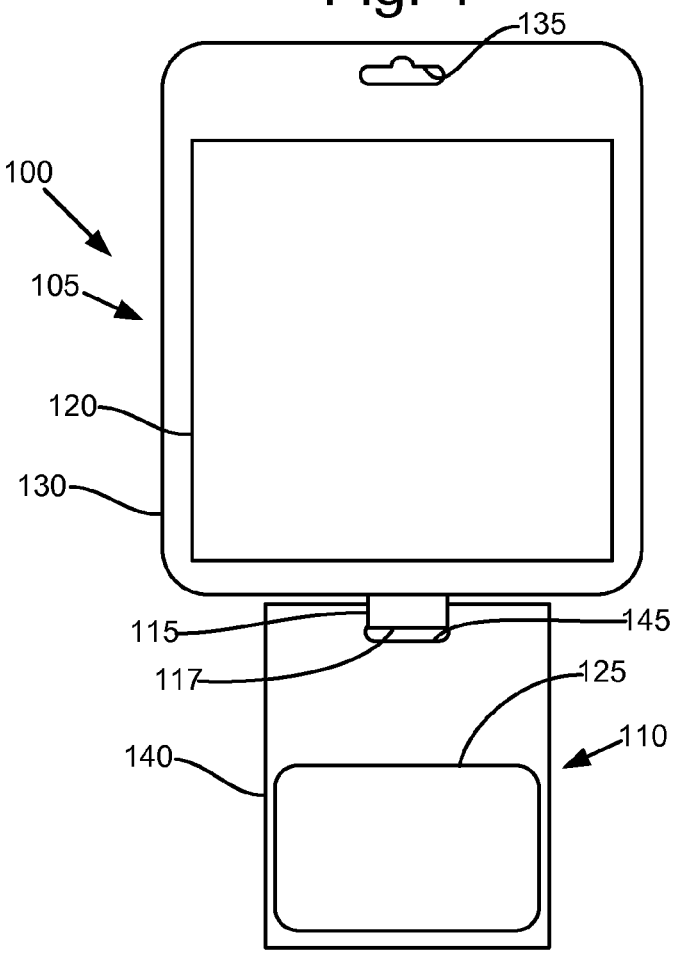
FIG. 4 is a front view of a gift card backer panel suspended from a holder backer panel via a looped tab.

In order to assemble an apparatus according to the system 100, the tab 115 is looped through the peg hole 145 of the second backer panel 140 and then affixed via adhesive 160 (such as a section of double stick tape) or equivalent means to a surface of the first backer panel 130, preferably but not necessarily the rear surface 130*b*, to form a loop 117 (see FIG. 4) by which the gift card assembly 110 may be suspended from the gift card holder assembly 105. As shown in FIGS. 1 and 2, the lower portion of the tab 115 is lifted upward in the direction of arrow B to generally pivot around line 115*b* to thereafter contact a target surface 130*g* of the rear surface 130*b* of the first backer panel 130 (as indicated by phantom lines 130*g* in FIG. 1) to form loop 117. It should be appreciated that the lower portion 115*c* of the tab 115 is first passed through the peg hole 145 of the gift card assembly 110 prior to attachment to the target surface 130*g* so that the tab 115 forms a loop 117 holding the second backer card 140 to the first backer card 130 and, therefore, the gift card assembly 110 to the gift card holder assembly 105, as shown in FIG. 4.

In certain embodiments of the system 100, the lower portion of the tab 115 (typically the rearward surface) is provided with a strip of adhesive 115*a* that contacts and adheres to the target surface 130*g* when the lower portion of the tab 115 is lifted to meet the first backer panel 130. In the other embodiments, the tab 115 is adhered to a section of double stick tape 160 located on the target surface 130*g* after the tab 115 is passed through the peg hole 145.

After purchase of a device according to the system 100, the gift card 125 may be removed from the second backer 140 and installed within or upon the gift card holder 120. In certain embodiments, the gift card holder 120 may then be detached from the first backer 130 card prior to giving the gift card holder 120 bearing the gift card 125 to a gift recipient. In further embodiments, an envelope is included with the system 100 and the gift card holder 120 is inserted into the envelope after it is detached from the second backer 140.

Figure 11:
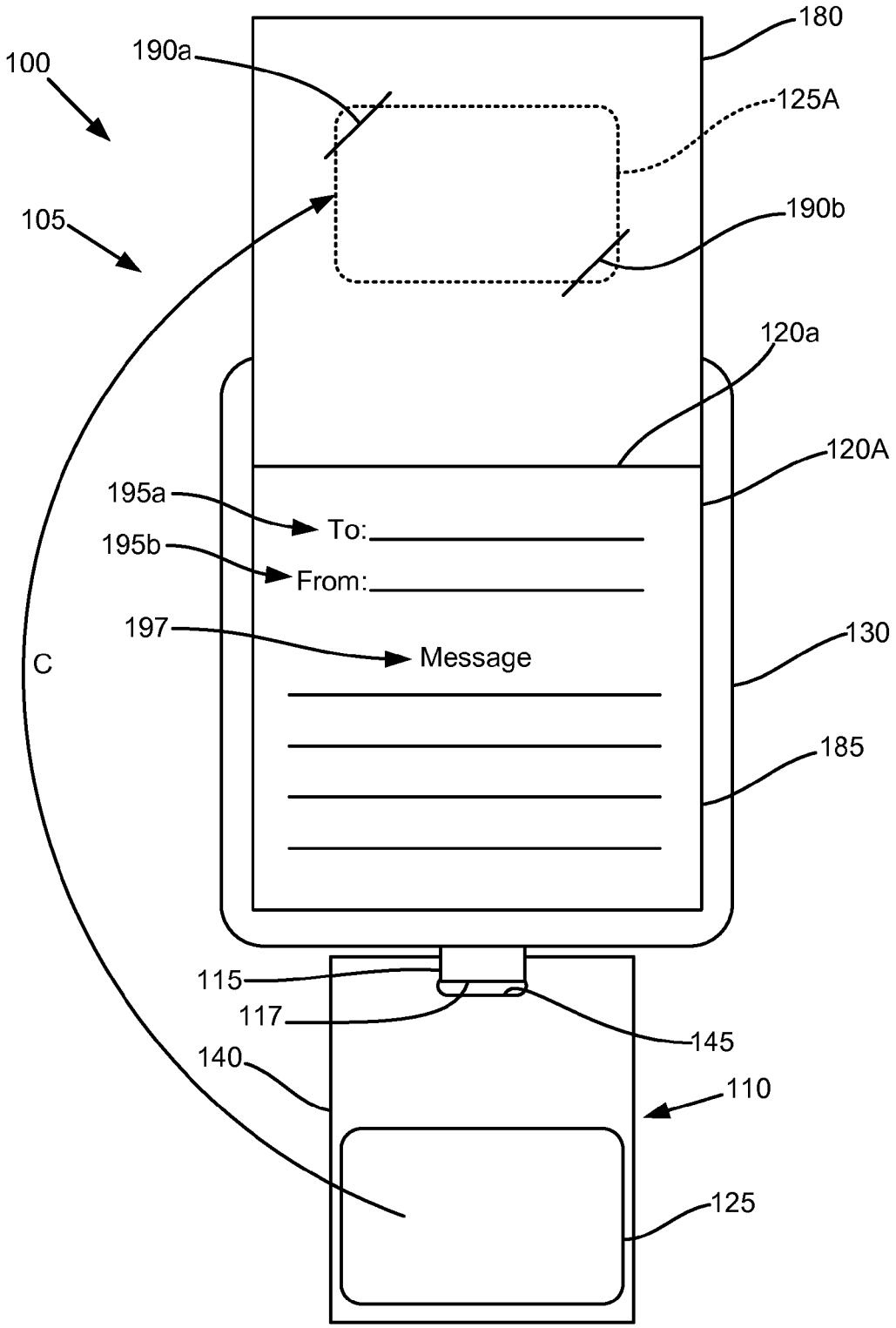
FIG. 11 is a front view of a gift card assembly suspended from a gift card holder assembly and showing the upper flap of a gift card holder lifted to show interior details.

FIG. 11 illustrates an example of a gift card holder 120A comprising two flaps of cardstock or the like defined from one another by a hinge or fold line 120*a*. Typically, as when presented for sale, the upper flap 180 lies flat against the lower flap 185, however, in this illustration the upper flap 180 is shown lifted upward to expose interior details, namely, slits 190*a* and 190*b* in the upper flap 180, to/from indicia 195*a* and 195*b* and message indicia 197. After purchase of a device according to the system 100, the gift giver (typically the buyer) may indicate the name of the gift recipient as prompted by the "To:" indicia 195*a*, the name of the gift giver as prompted by the "From:" indicia 195*b*, provide a written message as prompted by the "Message" indicia 197, and remove the gift card 125 from the second backer panel 140 and install it in the holder 120A as generally indicated by arrow C. The gift card 125 may be attached to or installed in the holder 120A by slipping diagonally opposing corners of the gift card into slits 190*a* and 190*b* as indicated in phantom lines 125A in FIG. 11.

Figure 12:
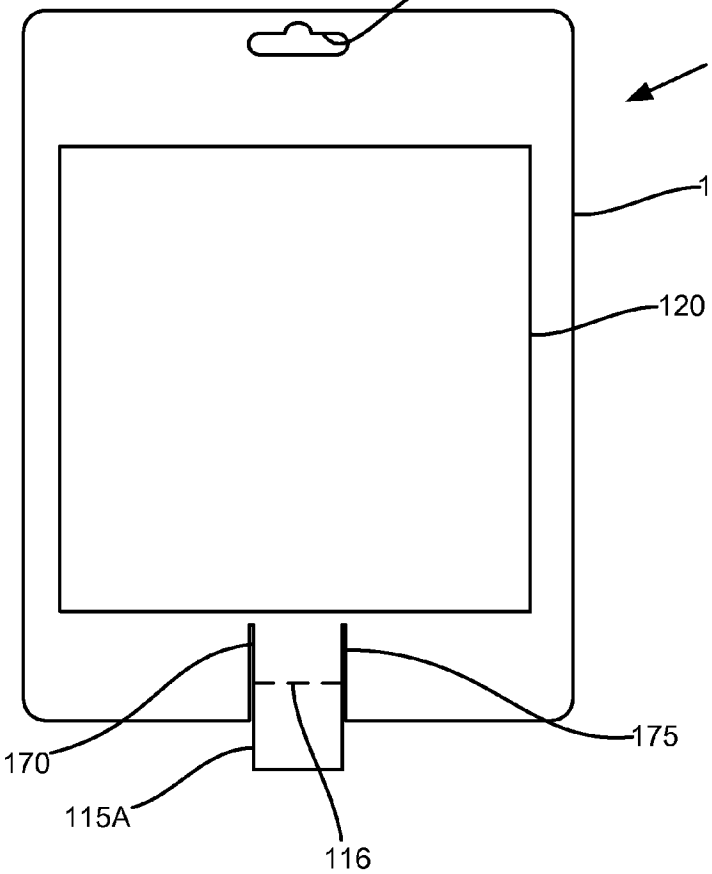
FIG. 12 is a front view of an alternative embodiment of a gift card holder assembly having a tab formed integrally from the gift card holder backer panel.

As illustrated in FIGS. 12 through 15, an alternative embodiment of the system 100A includes a first backer panel 130A with an integral strip 115A formed from the same piece of material (typically card stock, thin plastic, paper or the like) as the first backer panel 130A. FIG. 12 is a front view of a gift card holder assembly 105A having a tab or strip 115A formed integrally from the gift card holder backer panel (first backer panel 130A). The strip 115A may be scored 116 to facilitate bending it in the general direction indicated by arrow D after looping it through the second backer panel 140 peg hole 145. Notches 170 and 175 in the first backer panel 130A, separate and define an upper portion of the strip 115A from the adjacent portions of the backer panel 130A.

Figure 13:
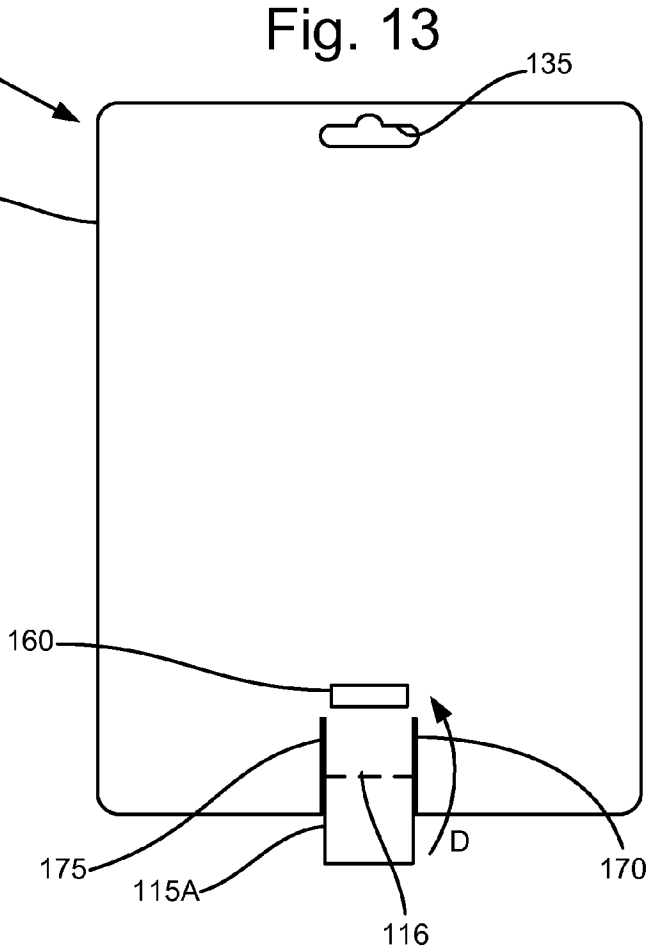
FIG. 13 is a rear view of the gift card holder assembly of FIG. 12.
Figure 15:
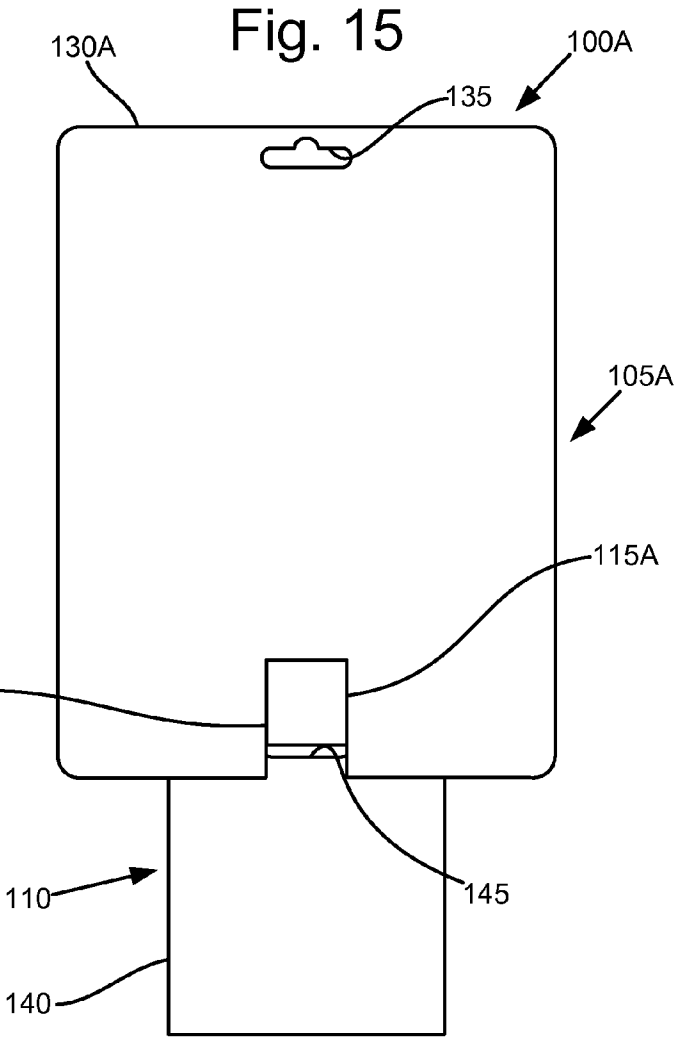
FIG. 15 is a rear view of the hanger system of FIG. 14.
Figure 14:
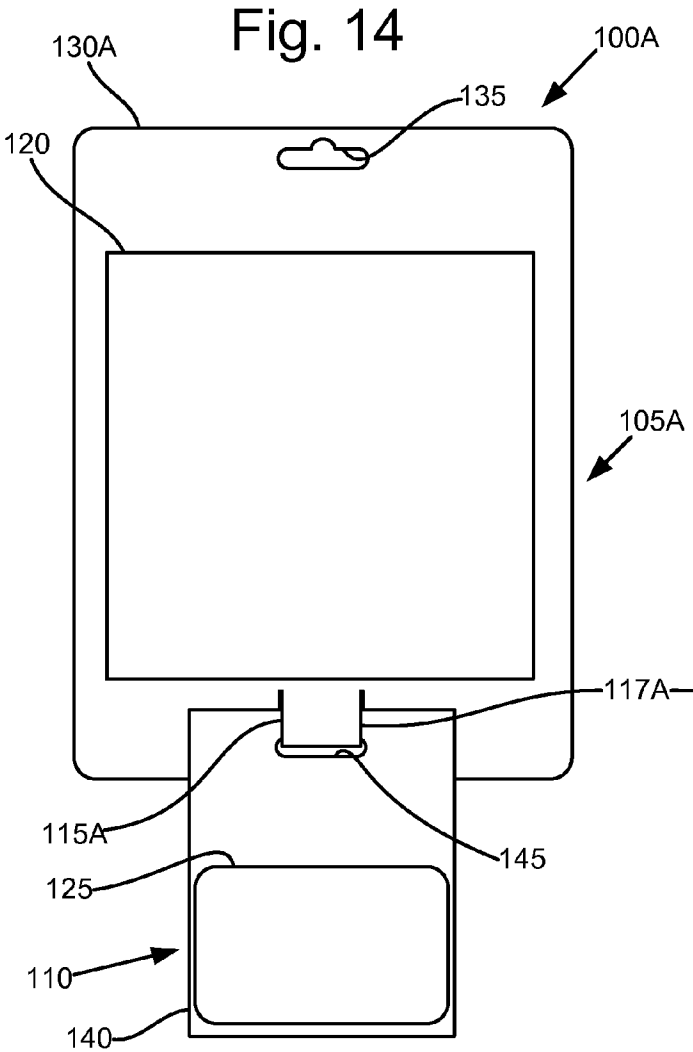
FIG. 14 is a front view of an alternative embodiment of a gift card hanger system showing a gift card assembly suspended from a gift card holder assembly by a looped tab integral to the gift card holder backer panel.

The notches 170 and 175 allow the second backer panel 140 to be drawn further upward and in overlapping engagement with the first backer panel 130A after the free end of the strip 115A is passed through the peg hole 145 and secured to the rear surface of the first backer panel 130A using adhesive 160, such as double stick tape or the like. As illustrated in FIG. 14, the upper portion of the second backer panel 140 slides into the notches 170 and 175 as the second backer panel 140 drawn upward by fastening the free end of the looped strip 115A to the back of the first backer panel 130A. Note that as indicated in FIG. 13, which shows a rear view of the first backer panel 130A, the adhesive may be placed near the free end of the strip 115A or on the rear surface of the first backer panel 130A at the point where the free end of the strip 115A will meet when secured to form a loop 117A. FIG. 14 is a front view of the gift card assembly 110 suspended from the gift card holder assembly 105A by the looped tab 115A integral to the gift card backer panel 130A. FIG. 15 is a rear view of the gift card assembly 110 suspended from the gift card holder assembly 105A via loop 117A.

Having thus described the invention, what is claimed as new and desired to be secured by Letters Patent is:

1. A transaction card hanger system comprising:

a transaction card assembly, comprising a panel engaged to a removable transaction card, the transaction card assembly attached to a transaction card holder assembly by suspending the card assembly from the holder assembly by an elongated tab configured as a loop, wherein the elongated tab is disposed proximal to the bottom most edge of the transaction card holder assembly and wherein the transaction card assembly hangs away from the transaction card holder assembly in a completely non-overlapping arrangement; and wherein the loop passes through an aperture of the transaction card assembly, and the loop is secured at a first end and second end of the tab to the holder assembly, with the transaction card assembly suspended between the first end and the second end.

2. The system of claim 1 wherein said transaction card holder assembly includes a holder to receive the removable transaction card removed from the transaction card assembly.

3. The transaction card hanger system of claim 1, wherein the transaction card holder assembly further comprises an electronic circuit.

4. The transaction card hanger system of claim 3, wherein the electronic circuit further comprises:

a speaker;

a power source;

a controller; and memory.

5. The transaction card hanger system of claim 1, wherein the panel further comprises at least one aperture aligned with indicia on the removable transaction card.

6. A transaction card hanger system comprising:

a transaction card holder assembly comprising a transaction card holder mounted upon a transaction card holder backer panel;

an elongated tab extending away from a bottom most edge of said transaction card holder assembly, said tab having a distal end initially free for passing through an aperture in a transaction card assembly, said transaction card assembly comprising a transaction card mounted upon a transaction card backer panel;

wherein the distal end is engaged to a surface of said transaction card holder assembly; and whereby said transaction card assembly hangs away from said transaction card holder assembly in a completely non-overlapping arrangement.

7. The transaction card hanger system of claim 6, wherein the transaction card holder assembly further comprises an electronic circuit.

8. The transaction card hanger system of claim 7, wherein the electronic circuit further comprises:

a speaker;

a power source;

a controller; and memory.

9. The transaction card hanger system of claim 6, wherein the transaction card backer panel further comprises at least one aperture aligned with indicia on the removable transaction card.

10. A gift card holder system comprising:

gift card holder assembly including a first backer panel;

a detachable gift card holder engaged to a face of the first backer panel;

an elongated tab extending from a lower portion of the first backer panel, the tab including a distal end in an initially free state;

a second backer panel engaged to a removable a gift card, the second backer panel including an aperture for accepting the distal end therethrough, wherein the distal end is engaged to the first backer panel upon passing through the aperture; and wherein the second backer panel assembly hangs on the elongated tab and projects away from the gift card holder assembly such that a majority of the second backer panel is disposed in a completely non-overlapping arrangement.

11. The gift card holder system of claim 10, wherein the detachable gift card holder comprises two hingedly connected panels and a removable adhesive or one or more slots for receiving and retaining the removable gift card.

12. The gift card holder system of claim 10, wherein the detachable gift card holder comprises a container including a flap closure.

13. The gift card holder system of claim 10, further comprising an aperture formed in an upper portion of the first backer panel, the aperture sized to accept a display stand peg.

14. The gift card holder system of claim 10, wherein the gift card holder assembly further comprises an electronic circuit.

15. The transaction card hanger system of claim 10, wherein the second backer panel comprises at least one aperture aligned with an indicia on the removable transaction card.

* * * * *